US011047077B2

(12) United States Patent
Giorgini

(10) Patent No.: US 11,047,077 B2
(45) Date of Patent: Jun. 29, 2021

(54) ENGINEERED FABRIC

(71) Applicant: Trerè Innovation S.r.l., Asola (IT)

(72) Inventor: Fabio Giorgini, Monticelli Brusati (IT)

(73) Assignee: Trerè Innovation S.r.l., Asola (IT)

( * ) Notice: Subject to any disclaimer, the term of this patent is extended or adjusted under 35 U.S.C. 154(b) by 34 days.

(21) Appl. No.: 16/304,839

(22) PCT Filed: May 30, 2017

(86) PCT No.: PCT/IT2017/000108

§ 371 (c)(1),
(2) Date: Nov. 27, 2018

(87) PCT Pub. No.: WO2017/208274

PCT Pub. Date: Dec. 7, 2017

(65) Prior Publication Data

US 2020/0325605 A1 Oct. 15, 2020

(30) Foreign Application Priority Data

Jun. 1, 2016 (IT) ..... 102016000056550

(51) Int. Cl.

| | |
|---|---|
| ***D04B 1/22*** | (2006.01) |
| ***D04B 1/10*** | (2006.01) |
| ***D04B 1/12*** | (2006.01) |

(52) U.S. Cl.

CPC ..... *D04B 1/22* (2013.01); *D04B 1/106* (2013.01); *D04B 1/126* (2013.01); *D10B 2403/0114* (2013.01); *D10B 2403/021* (2013.01); *D10B 2501/043* (2013.01)

(58) Field of Classification Search

CPC ..... D04B 1/22; D04B 1/106; D04B 1/126; D04B 1/24; D04B 7/24; D04B 7/28; D04B 7/30

See application file for complete search history.

(56) References Cited

U.S. PATENT DOCUMENTS 5,385,036 A * 1/1995 Spillane ..... A43B 1/04 2/16

5,413,837 A 5/1995 Rock et al.

(Continued)

FOREIGN PATENT DOCUMENTS

DE 10 2009 025 466 12/2010

OTHER PUBLICATIONS

International Search Report dated Nov. 27, 2017 in International (PCT) Application No. PCT/IT2017/000108.

*Primary Examiner* — Danny Worrell

(74) *Attorney, Agent, or Firm* — Wenderoth, Lind & Ponack, L.L.P.

(57) ABSTRACT

A footwear upper is made of a knitted engineered fabric. The footwear upper includes a front portion for covering an upper part of a foot, an intermediate portion corresponding to an insole, and a rear portion for covering a heel. The front portion, the intermediate portion and the rear portion are produced with an engineered fabric composed of an internal core and a pair of external layers of knitted fabric. The footwear upper is made as one piece, is already contoured during a machining stage and is ready to be applied to a sole without any other type of machining, except for the possibility of sealing for joining the front portion to the rear portion laterally.

15 Claims, 3 Drawing Sheets

(56) References Cited

U.S. PATENT DOCUMENTS

| | | | | | |
|---|---|---|---|---|---|
| 5,783,277 | A * | 7/1998 | Rock | B32B 5/26 | 428/86 |
| 5,896,758 | A * | 4/1999 | Rock | A43B 1/04 | 66/191 |
| 6,156,406 | A * | 12/2000 | Rock | B32B 5/12 | 428/86 |
| 7,913,520 | B1 * | 3/2011 | Chen | D04B 1/16 | 66/196 |
| 9,677,209 | B2 * | 6/2017 | Daube | D04B 21/20 | |
| 10,130,129 | B2 * | 11/2018 | Rock | D05B 11/00 | |
| 10,738,417 | B2 * | 8/2020 | Crawford | B32B 5/06 | |
| 2007/0144221 | A1 | 6/2007 | Sytz | | |
| 2008/0006060 | A1 * | 1/2008 | Park | F25B 21/04 | 66/170 |
| 2015/0099410 | A1 * | 4/2015 | Bahukudumbi | B32B 25/16 | 442/1 |

* cited by examiner

ENGINEERED FABRIC

TECHNICAL FIELD

The present invention relates to an engineered fabric produced using a knitted fabric which is particularly suitable for providing good grip and protection for the parts of the human anatomy with which it comes into contact.

BACKGROUND ART

As is known, engineered fabrics are materials which meet high technical and quality requirements and are used to produce products with superior performance levels which meet the needs of the field of application thereof, including sportswear, but also for many other everyday items.

In particular, in the engineered fabric system, all kinds of textile fibres are used, such as, for example, natural, synthetic, artificial, inorganic fibres, with an increasing diffusion of the use of synthetic fibres, because it is possible to provide them with features suitable for the needs of different applications. In fact, technical fibres are designed and manufactured to provide performance levels not reachable with conventional textile fibres; they are mainly characterised by high levels of resistance to mechanical stress, flames, and chemical agents. These features can be achieved by modifying the process or other parameters that, apart from the fibres, contribute to the formation of the desired product. Fabrics made with the use of technical fibres can excel in terms of thermal exchange capacity, mechanical resistance, and durability.

Depending on the field of application, the technological features can be accompanied by comfort and style aspects. At present, engineered fabrics are finding increasing use in the clothing field, thus representing a meeting point between two worlds, namely fashion and engineering, which have ever larger areas of overlap. Engineered fabrics for both casual and sports clothing must combine comfort, resistance, and ease of use and maintenance with design and the use of innovative technologies, such features being guaranteed by the choice of the fibres and the production processes.

Nowadays, in pursuit of ever-increasing specialisation in clothing and other objects, the performance offered by the constituent fabric and the technological features of the said clothing and other objects in which the fabrics are employed are becoming increasingly advanced.

In addition to the explanations so far, there is a demand expressed by the market for—for example—engineered fabrics which are capable, at the same time, of adapting to human ergonomics and offering optimum comfort and protection for the parts of the body with which the fabric comes into contact. In particular, the item of clothing or the accessory is required to feature the fewest number of seams possible since, with time and prolonged use, seams can irritate the body part concerned and the pressure exerted thereby can create irritations that limit the wearability of the item.

As it is known, nowadays, there is a lot of interest among users in clothes and accessories which are comfortable, practical, functional, aesthetically pleasing, and flexible in terms of the use thereof, but most of all in those with high technological performance levels.

Indeed, it is a known fact, for example, that sportsmen and women (among others) are particularly demanding and careful about their choices when it comes to the footwear, clothing, and accessories they use for their sporting activities, which means they refuse to accept compromises such as objects which do not meet up to their expectations and needs, and which even sometimes wrongfully heighten expectations.

DISCLOSURE OF INVENTION

The aim of the present invention is essentially to solve the problems of the commonly known technique, overcoming the drawbacks described above by means of a one-piece, machine-finished, engineered fabric produced with a layering of components but without interruptions, seams or raw edges either around the edges or in other zones.

A second aim of the present invention is to provide an engineered fabric which adapts perfectly to the morphology of the part of the body with which it comes into contact, featuring differentiated thicknesses in the knit sequences achieved through differentiated interwoven sections in the machining.

A further aim of the present invention is to produce an engineered fabric using a knitting machine, which is able to offer the user optimum ergonomics, good foot grip, excellent breathability, decidedly contained weight, support, and remarkable comfort when worn.

A still further aim of the present invention is to produce a an engineered fabric which features variable thickness inserts which offers support and/or contact points with varying degrees of softness or hardness, as needed.

A still further aim of the present invention is to produce an engineered fabric whose construction features alternating areas with varying degrees of padding, which are lightweight and perforated so as be breathable.

A further but not final aim of the present invention is to produce an engineered fabric which is easy to manufacture and works well.

These aims and others besides, which will better emerge over the course of the present description, are essentially achieved by means of an engineered fabric, as outlined in the claims below.

BRIEF DESCRIPTION OF DRAWINGS

Further features and advantages will better emerge in the detailed description of an engineered fabric according to this invention, provided in the form of a non-limiting example, with reference to the accompanying drawings, in which.

Figure 1:
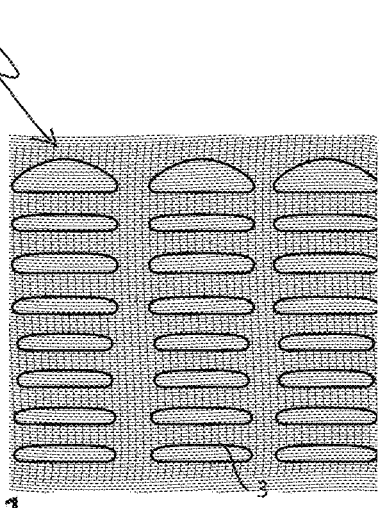
FIG. 1 shows, schematically, a top view of a first embodiment of an engineered fabric according to the present invention.
Figure 2:
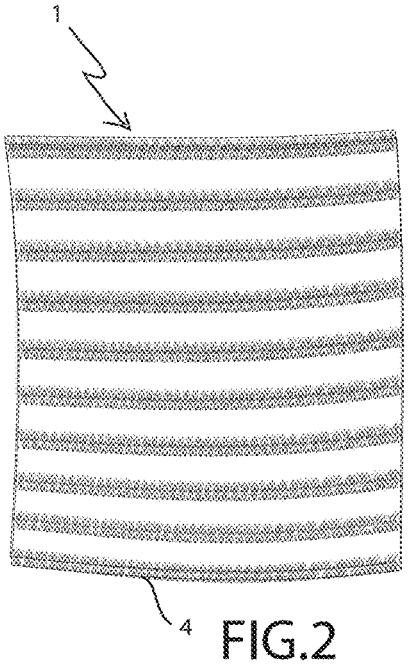
FIG. 2 shows, schematically, a top view of a second embodiment of the engineered fabric in question.
Figure 3:
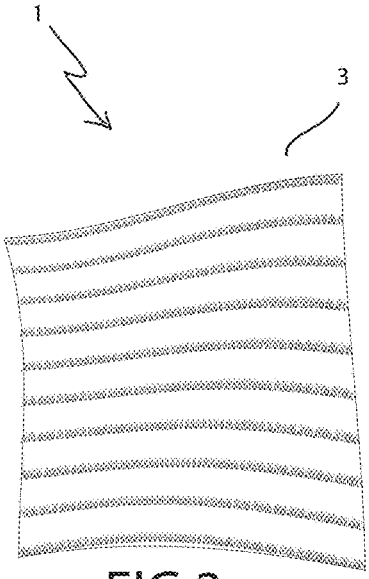
FIG. 3 shows, schematically, a top view of a third embodiment of the engineered fabric in question.
Figure 4:
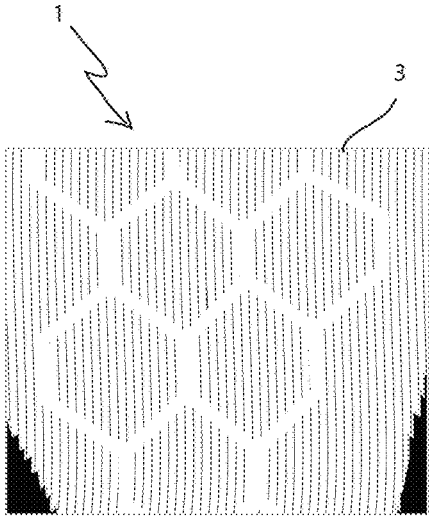
FIG. 4 shows, schematically, a top view of a further embodiment of the engineered fabric in question.

With reference to the figures, 1 denotes, as a whole, a an embodiment of an engineered fabric according to the present invention.

BEST MODE FOR CARRYING OUT THE INVENTION

The engineered fabric in question is essentially comprised of an internal core 2 and a pair of external layers 3 and 4 of knitted fabric. The external layers 3 and 4 which cover the core feature different thicknesses due to the use of different yarns, as well as the type of machining carried out on the same row.

In fact, the fabric can be manufactured with various types of yarns, including yarns interwoven with one other (with reference to both the core and the external layers).

In particular, the yarn employed for the production of the external layers is a natural or synthetic yarn, a combination of the two types, or an interweaving of different types and thicknesses of yarn.

In addition to the explanations so far, the fabric preferably features a core made of a synthetic material, such as polyester, nylon, and others with equivalent features, consisting of a yarn with particular machining which acts as a cavity and a connection between the two external layers. The machining to form the yarn which comprises the core consists of an interweaving of the yarn used in the weave, whose final effect is a kind of zigzagging of the yarn, which engages once with the internal side of one layer and then again with the internal side of the other (external) layer of knitted fabric, as shown in detail in FIG. 5. In greater detail, the structure of the core consists of interwoven yarns anchored to the external layers so as to create a mesh which can vary in height, and therefore, in terms of core thickness, yarn density, and yarn spacing.

In fact, a less dense distribution of the yarns creates a softer, airier, and more breathable core, while a denser, more compact distribution of the yarns make a stiffer and more stress-resistant core.

In particular, the core 2 has a climate control function as it creates a cavity between the two external layers and sectors are obtained which are cooler or warmer and/or varyingly breathable depending on the thickness of the core.

In accordance with the present invention, the fabric may have different internal thicknesses which allow for a more specific and sectoral design of the piece, thereby also allowing the product to be provided with specific technical features at points of need.

In fact, for example, the thickness of the core allows the fabric to have controlled flexibility and the thicker the core is, the more flexible and soft the fabric is. The features of the core are combined with and added to the features of the external layers.

In addition, the thicker it is, the more padded the fabric is, thereby guaranteeing greater support and, consequently, better comfort. Furthermore, the more padded zones provide greater protection.

In addition to the explanations so far, the thicker the core, the more the fabric offers optimum climate control for the part of the body with which it comes into contact, as the way in which the core is produced means it is endowed with open channels that allow better and greater air circulation and therefore better climate control as where the core is thicker, the air circulates better and more easily, keeping the temperature even and constant, while when the air reaches an area which is less thick and the weave is denser, the air slows down, resulting in a temperature increase as there is less possibility of dispersion. In this way, differentiated comfort zones are possible.

In addition to the above, when the core is less thick, the fabric can provide greater support to the contact area since the said fabric is stiffer and more compact. Furthermore, the less thickness allows the fabric obtained to be more resistant to pressure and impacts and external stress. In particular, greater thickness better absorbs light yet prolonged stress, as it has a more elastic response while less thickness absorbs shorter but more intense stress.

Figure 5:
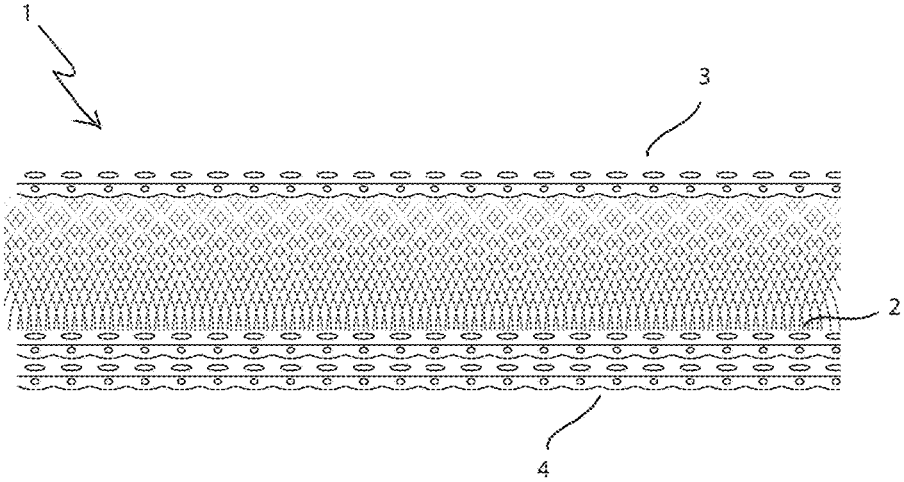
FIG. 5 shows, schematically, a section view of an engineered fabric according to the present invention.
Figure 6:
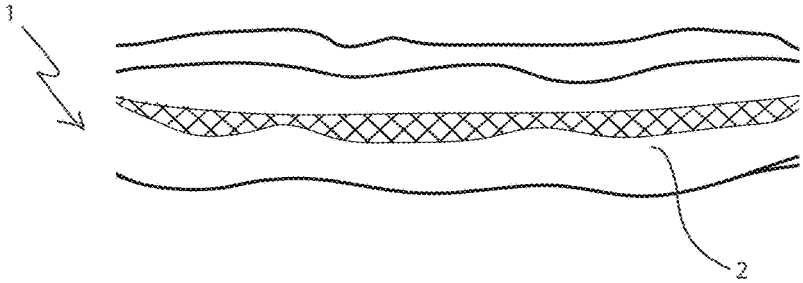
FIG. 6 shows, schematically, a section view of a different engineered fabric according to the present invention.
Figure 7:
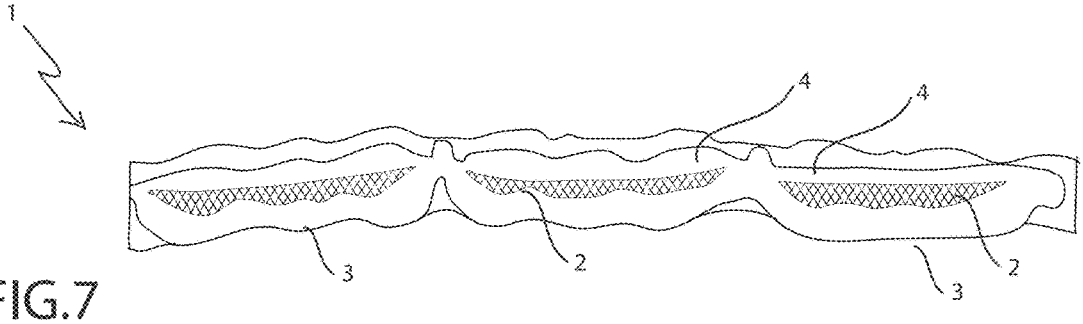
FIG. 7 shows, schematically, a section view of a further engineered fabric according to the present invention.
Figure 8:
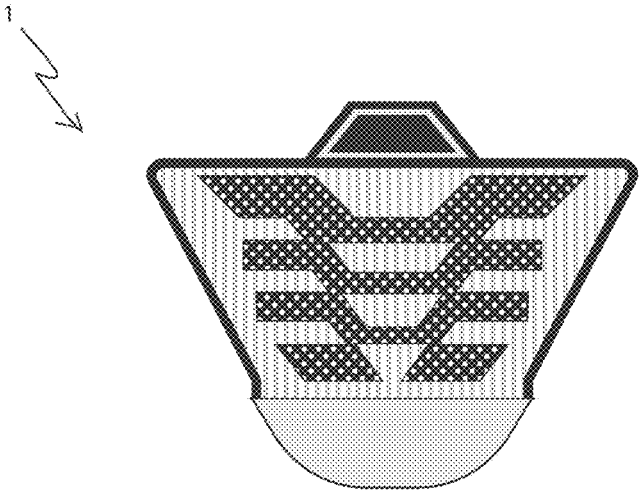
FIG. 8 shows, schematically, a top view of a different embodiment of an engineered fabric according to the present invention.
Figure 9:
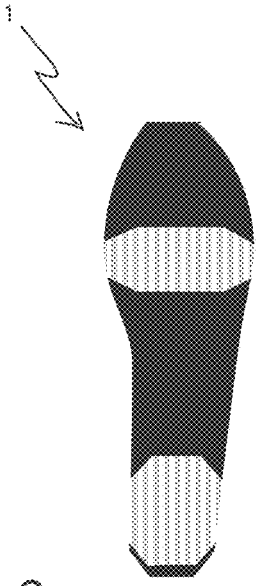
FIG. 9 shows, schematically, a top view of a further embodiment of an engineered fabric.

As previously mentioned and as shown in FIG. 5, the core is covered by two layers of full fabric 3 and 4, the said fabric being produced with a knitting machine with several needle beds. Furthermore, the external layers can be the same on both sides or can be machined differently.

In fact, one side may have one type of machining while the corresponding one, on the other side, is different. In addition, for example, one layer can be endowed with openings to create zones with particular breathability in order to capture heat and/or humidity from the area in contact if placed inside, such as, for example, from a foot if the fabric is used as a footwear upper or from a hand if used for a glove or by the back if used for upholstery for, for example, a car seat.

In addition to the explanations so far, when—for example—the fabric features machining which creates a full knit located externally, it prevents the inlet of humidity and drastically reduces the possibility of water getting inside.

In particular, the presence of perforations and openings for the passage of air does not, however, allow the inlet of powder, sand, etc. so nothing enters the fabric that could cause discomfort to the foot, hand, or any other part of the body.

Furthermore, within the contour of each layer of fabric, various knitting structures are used, such as jersey on both sides, rib knit, interlock knit, vanisé knit, jacquard knit, coloured jacquard knit, tuck stitch knit, open-work knit, cable knit, knits with a design, and knits with an inlaid design. The said fabric being contoured as produced with knits which allow pre-shaping (anatomical) by means of different selections, yarns, and gauges. Different types of machining guarantee that the engineered fabric obtained has structural features that are transformed into functional features for the item of clothing, accessory, footwear, or any other object for which the engineered fabric is utilised.

According to the present invention, the engineered fabric leaves the machining with the edging sealed, which means said fabric is stronger and less prone to damage because the core yarns, present inside, cannot protrude therefrom and, at the same time, nothing can be inserted into the interior. Furthermore, the sealed edging of the engineered fabric facilitates the insertion thereof into, for example, the rubber of the sole (for footwear) or allows easy stitching without fraying or the insertion thereof in an item of clothing. In fact, since the edging is already sealed during machining, this allows it to be less thick and therefore the quality level is better, and it is more durable and does not require any further machining.

Furthermore, the engineered fabric may have different edgings depending on the needs.

In particular, the engineered fabric in all its forms undergoes contouring already in the machining phase and comes out of the machine already shaped, finished, ready to be applied without any other type of machining, except subsequent machining to assemble the object or produce the item of clothing or accessory.

In fact, the engineered fabric in question can be used to produce, as mentioned earlier, footwear and gloves (for both sport and non-sports use), and can be used in the production of items of clothing (both sports and casualwear), or even only parts thereof where particular features and performance levels are required. It can also be used to make padding, for example, for helmets, for the crotch liner of cycling shorts and trousers, as technical padding for clothing and much more besides. In addition, the engineered fabric can be applied as a upholstery and reinforcement for vehicle seats, as upholstery and padding for chairs and sofas, and in any other application which involves contact and human ergonomics.

As mentioned earlier and to better illustrate the structural features of the engineered fabric in question, when—for example—said fabric is used to produce a footwear upper (for sports or casual footwear), more resistant yarns are used at the pressure points (heel or toe) to make the external layer in that zone, in order to make the portion less prone to wear, and the same applies to the toe. In order to obtain particular features or performances in the different zones of the engineered fabric, it is possible to change both the structure and the material with which each zone is constructed.

Figure 10:
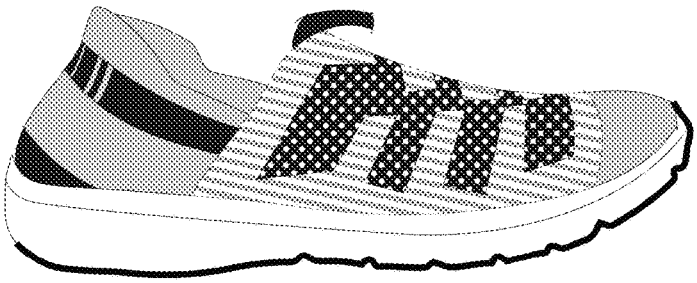
FIG. 10 shows a side view of an item of footwear produced with the engineered fabric in FIG. 8.
Figure 11:
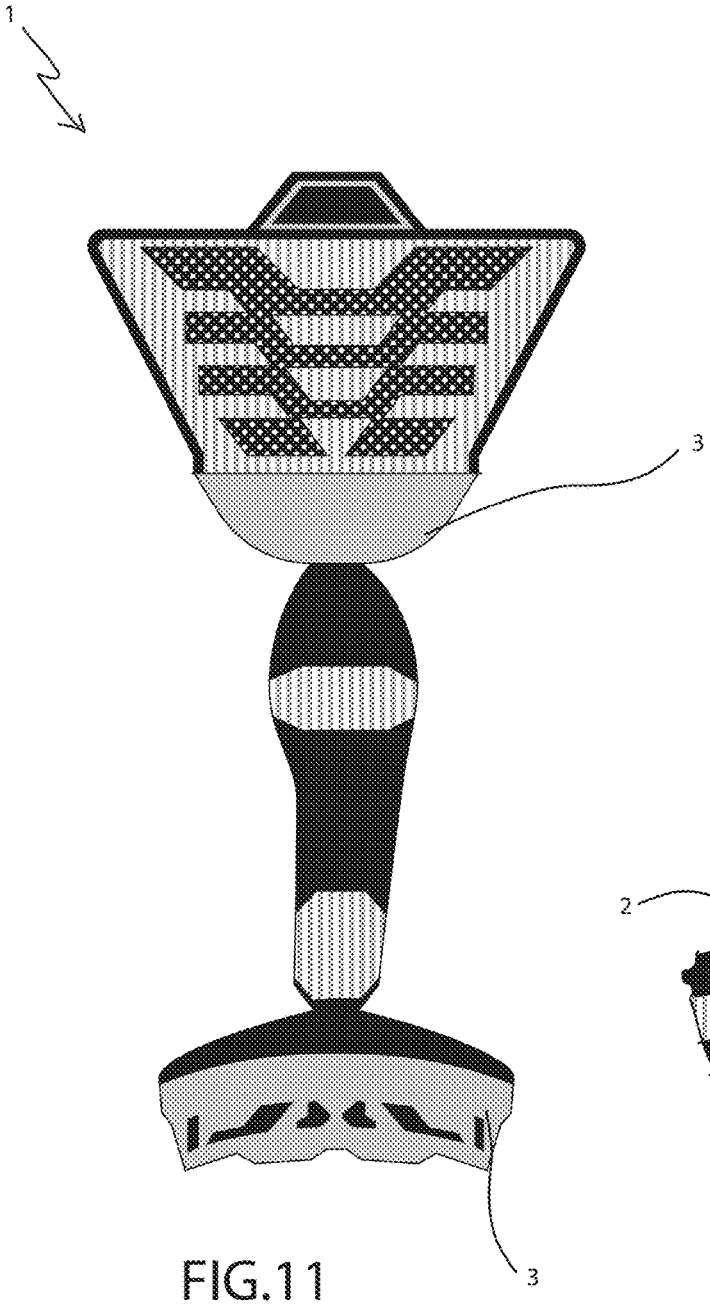
FIG. 11 shows, schematically, a top view of the form of the footwear upper in FIG. 10 produced with the engineered fabric in FIG. 8.
Figure 12:
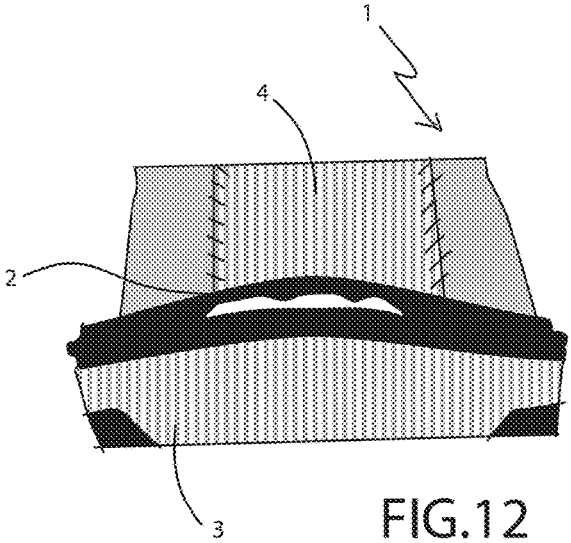
FIG. 12 shows, schematically, a detail of the section view of the engineered fabric in FIG. 8.

All the inserts and the different types of structure of the engineered fabric are obtained during machining, which means there are no seams that can cause discomfort, irritations, or stress to the zone of the body which comes into contact therewith. In fact, for example, as shown in FIGS. 10 and 11, when producing an upper, there are no seams in the toe area and there are no inserts for inserting laces, as there are with current shoes.

In addition to the explanations so far, the engineered fabric according to the present invention is produced with the desired contouring, which means the item to produce is formed from a single piece, without any interruptions, seams (except the lateral sealing), hard edges and/or raw edges, since it leaves the machine finished. In fact, an item like the upper is constructed in a single machining phase and comes out of the machine complete, which means no subsequent steps are required, except the assembly thereof with other components, like the sole or—if it is padding for a helmet—the hard shell. In particular, the edgings are soft and this condition makes the shoe or the helmet or the gloves fit comfortably, without the risk of irritation or discomfort where the presence of stiff edges can cause discomfort in the long run.

Last but not least, the engineered fabric in question is the end result of precise working phases, which means the resulting fabric is the epitome of high-performance technique, which can be applied to fashion, sports, etc.

After the predominantly structural description, the invention in question will now be outlined.

When one wishes to produce an item, be it a glove, footwear, garment, or part thereof, or upholstery for a chair or a seat, one simply has to shape the engineered fabric according to the present invention and use said fabric to obtain the desired object so that—if it is a footwear upper—the piece of fabric leaves the machine already shaped, as shown in FIG. 11, and is simply joined to the sole, while if it is upholstery for a seat, it is fitted on the body, and if it is an item of clothing, it is assembled with the other components in the same way as a normal piece of fabric. The difference will lie in the performance and the characteristics that the fabric can offer as support for the various zones of contact with the body, being differentiated from one sector to another sector, with optimum comfort, diversified depending on the points in the body, climate control which can be different from one zone to another zone, and reinforced zones which will protect parts of the body from impacts and blows and other parts of the body will be helped and supported, as well as protected during the various movements thereof. Thus the present invention achieves the aims set.

The engineered fabric in question adapts perfectly to the morphology of the part of the body with which it comes into contact or the shape of the object with which it will be combined, features differentiated thicknesses in the sequences of the different rows of knitting and features differentiated interwoven sections in the machining, which allow a portion of fabric to be obtained which offers optimum breathability with differentiated zones for aeration and air circulation as needed, a suitable housing for the toes or hand, and protection of the parts of the foot against impacts and stress, or of the hand or head, with an either stiffer or more flexible engineered fabric, depending on the needs for protection and comfort required by the part of the body.

One advantage of the engineered fabric is that it is produced using a knitting machine without the need for subsequent machining, except the subsequent assembly thereof with, for example, the sole, the shell for the helmet, with the trousers or shorts for the crotch liner, etc. and gives the user an object which has optimum support, grip, and protection, excellent breathability, decidedly contained weight, support, and remarkable comfort when worn.

In addition to the explanations so far, the fabric in question features variable thickness inserts which provide the part of the body with support points with varying degrees of softness or hardness as needed.

Furthermore, the construction of the engineered fabric according to the present invention involves alternating areas with varying degrees of padding, which are lightweight and perforated so as to be breathable and provide heat regulation.

A further advantage of the engineered fabric in question is that it has no additional components since it is made from a single element.

In particular, because of its structure, the fabric according to the present invention adapts perfectly to the morphology of the part of the body, without any uncomfortable thickness, and features defined zones with greater grip and support.

In addition, the fabric allows for sectors and zones with varying degrees of flexibility or stiffness within the same sector.

Advantageously, the item of clothing or the accessory comprising the fabric according to the present invention allows for a considerable reduction in the mechanical stress on the user's skin, bones, muscles and tendons, in addition to preventing contusions in the body parts subject to impacts and blows, such as, for example, the foot.

One advantage achieved with the use of the present engineered fabric is that the user's performance improves since the elements of disturbance and discomfort are reduced, making the user much safer during the movements thereof. This is the case when the fabric is used as a crotch liner, as a footwear upper, or as part of an item of clothing.

A further advantage is due to the fact that the engineered fabric in question is easy to manufacture and works well.

Naturally, further modifications or variants may be applied to the present invention while remaining within the scope of the invention that characterises it.

The invention claimed is:

1. An engineered fabric comprising:

an internal core; and a pair of external layers of knitted fabric, wherein:

the internal core is covered by the pair of external layers;

the internal core is composed of a yarn with a construction which serves as a cavity and as a connection between the pair of external layers;

the construction is composed of an intertwining of the yarn used in a weave of the knitted fabric resulting in a zigzagging of the yarn, which engages with an internal side of a first of the pair of external layers and an internal side of a second of the pair of external layers such that the yarn is anchored to the pair of external layers so as to create a mesh;

the pair of external layers have different thicknesses resulting from use of different yarns;

the engineered fabric has sealed edging such that the yarn of the internal core does not protrude from the internal core; and the engineered fabric is pre-shaped such that when the engineered fabric is constructed, the engineered fabric is finished and ready to be utilized without further processing, except for assembly of an object in which the engineered fabric is to be used.

2. The engineered fabric according to claim 1, further comprising padding.

3. The engineered fabric according to claim 1, wherein the engineered fabric has variable thickness.

4. The engineered fabric according to claim 1, wherein the internal core includes open channels.

5. The engineered fabric according to claim 1, wherein the engineered fabric is made as a single, continuous piece.

6. The engineered fabric according to claim 1, wherein the internal core has variable yarn distribution.

7. The engineered fabric according to claim 1, wherein the engineered fabric includes a plurality of sectors for varying climate control.

8. The engineered fabric according to claim 1, wherein:

the yarns of the pair of external layers are natural yarns, synthetic yarns or a combination of the natural yarns and the synthetic yarns; and the yarn of the internal core is made of a synthetic material.

9. The engineered fabric according to claim 8, wherein the synthetic material is polyester or nylon.

10. The engineered fabric according to claim 1, wherein the yarns of the pair of external layers have different knit structures.

11. The engineered fabric according to claim 10, wherein the knit structures include jersey, rib knit, interlock knit, vanisé knit, jacquard knit, tuck stitch knit or open-work knit cable knit.

12. The engineered fabric according to claim 11, wherein the jacquard knit includes coloured jacquard knit, knit with a design or knit with an inlaid design.

13. The engineered fabric according to claim 10, wherein the yarns of the pair of external layers have different gauges.

14. The engineered fabric according to claim 1, wherein at least one of the pair of external layers includes openings for climate control.

15. The engineered fabric according to claim 1, wherein at least one of the pair of external layers has a full knit construction.

* * * * *